US007886471B2

(12) United States Patent
Glock

(10) Patent No.: US 7,886,471 B2
(45) Date of Patent: Feb. 15, 2011

(54) METHOD FOR ACTIVATING A WEAPON WITH AN IDENTIFICATION MECHANISM

(76) Inventor: Gaston Glock, Klagenfurther Str. 32a, A-9220 Velden am Woerthersee (AT)

( * ) Notice: Subject to any disclaimer, the term of this patent is extended or adjusted under 35 U.S.C. 154(b) by 0 days.

(21) Appl. No.: 10/771,914

(22) Filed: Feb. 4, 2004

(65) Prior Publication Data

US 2004/0244253 A1 Dec. 9, 2004

Related U.S. Application Data

(62) Division of application No. 10/263,373, filed on Oct. 2, 2002, now abandoned.

(30) Foreign Application Priority Data

Oct. 2, 2001 (DE) ..... 101 48 676

(51) Int. Cl.
*F41A 17/00* (2006.01)

(52) U.S. Cl. ..... 42/70.11; 42/70.01

(58) Field of Classification Search ..... 42/70.01, 42/70.06, 70.08, 70.11, 84, 66
See application file for complete search history.

(56) References Cited

U.S. PATENT DOCUMENTS 4,003,152 A * 1/1977 Barker et al. ..... 42/70.01
4,354,189 A * 10/1982 Lemelson ..... 340/5.61
4,394,773 A * 7/1983 Ruell ..... 382/124
4,453,161 A * 6/1984 Lemelson ..... 340/5.63
4,488,370 A * 12/1984 Lemelson ..... 42/70.01
5,062,232 A * 11/1991 Eppler ..... 42/70.11

(Continued)

FOREIGN PATENT DOCUMENTS

DE 43 03 333 A1 6/1994

(Continued)

OTHER PUBLICATIONS (http://www.merriam-webster.com/dictionary/intermittent), retrieved Apr. 10, 2009.*

(Continued)

*Primary Examiner*—Troy Chambers
(74) *Attorney, Agent, or Firm*—Flynn, Thiel, Boutell & Tanis, P.C.

(57) ABSTRACT

A system for activating a weapon to a state of readiness to fire includes an identification mechanism which is carried by the user of the weapon. The identification mechanism includes a sensor configured to input an identification code, a store configured to store the identification code and a transmitter. A receiver is provided in the weapon. The transmitter sends an activation signal to the receiver upon a positive identification code comparison. The activation signal activates the weapon to a state of readiness to fire. To maintain the weapon in this activation state, the transmitter continuously emits a signal to the receiver. The receiver controls a processor which is configured to maintain the weapon in the activation state based exclusively on the strength of the signals continuously being received by the receiver. To maintain the weapon in this state, the strength of the received signals must be equal to or greater than the strength of the signals received by the receiver when the identification mechanism is at a specified distance from the weapon.

22 Claims, 1 Drawing Sheet

U.S. PATENT DOCUMENTS

| | | | | | |
|---|---|---|---|---|---|
| 5,168,114 | A | * | 12/1992 | Enget | 42/70.01 |
| 5,448,847 | A | * | 9/1995 | Teetzel | 42/70.11 |
| 5,459,957 | A | * | 10/1995 | Winer | 42/70.11 |
| 5,461,812 | A | * | 10/1995 | Bennett | 42/70.11 |
| 5,502,915 | A | * | 4/1996 | Mendelsohn et al. | 42/70.11 |
| 5,537,771 | A | * | 7/1996 | Martin | 42/70.01 |
| 5,546,690 | A | * | 8/1996 | Ciluffo | 42/70.11 |
| 5,564,211 | A | * | 10/1996 | Mossberg et al. | 42/70.11 |
| 5,570,528 | A | * | 11/1996 | Teetzel | 42/70.11 |
| 5,675,925 | A | * | 10/1997 | Wurger | 42/70.11 |
| 5,704,151 | A | * | 1/1998 | West et al. | 42/70.07 |
| 5,828,301 | A | * | 10/1998 | Sanchez | 340/539.1 |
| 5,832,296 | A | * | 11/1998 | Wang et al. | 710/3 |
| 5,937,557 | A | | 8/1999 | Bowker et al. | |
| 5,953,844 | A | * | 9/1999 | Harling et al. | 42/70.06 |
| 6,098,330 | A | * | 8/2000 | Schmitt et al. | 42/70.11 |
| 6,223,461 | B1 | * | 5/2001 | Mardirossian | 42/70.11 |
| 6,314,671 | B1 | * | 11/2001 | Gering | 42/70.11 |
| 6,321,478 | B1 | * | 11/2001 | Klebes | 42/84 |
| 6,343,140 | B1 | * | 1/2002 | Brooks | 382/115 |
| 6,343,429 | B1 | * | 2/2002 | Mossberg et al. | 42/70.01 |
| 6,363,647 | B2 | * | 4/2002 | Kaminski | 42/70.11 |
| 6,408,555 | B1 | * | 6/2002 | Sapia et al. | 42/70.07 |
| 6,412,207 | B1 | * | 7/2002 | Crye et al. | 42/70.06 |
| 6,429,769 | B1 | * | 8/2002 | Fulgueira | 340/5.33 |
| 6,510,640 | B2 | * | 1/2003 | Strong | 42/70.07 |
| 6,510,642 | B2 | * | 1/2003 | Riener | 42/70.11 |
| 6,856,238 | B2 | * | 2/2005 | Wootton et al. | 340/5.61 |
| 2001/0032407 | A1 | * | 10/2001 | Cain et al. | 42/70.11 |
| 2002/0032976 | A1 | | 3/2002 | Riener | |
| 2002/0112390 | A1 | * | 8/2002 | Harling et al. | 42/70.11 |

FOREIGN PATENT DOCUMENTS

| | | | | |
|---|---|---|---|---|
| DE | 4446020 | A1 | * | 6/1996 |
| FR | 2551856 | | * | 3/1985 |
| WO | WO/98/04880 | | * | 2/1998 |
| WO | WO 98/04880 | A1 | | 2/1998 |
| WO | WO/01/18332 | | * | 3/2001 |
| WO | WO 01/18332 | A1 | | 3/2001 |

OTHER PUBLICATIONS

Adams, "Technology: a way out of gun impasse", Washington Post, Mar. 19, 2000.*

* cited by examiner

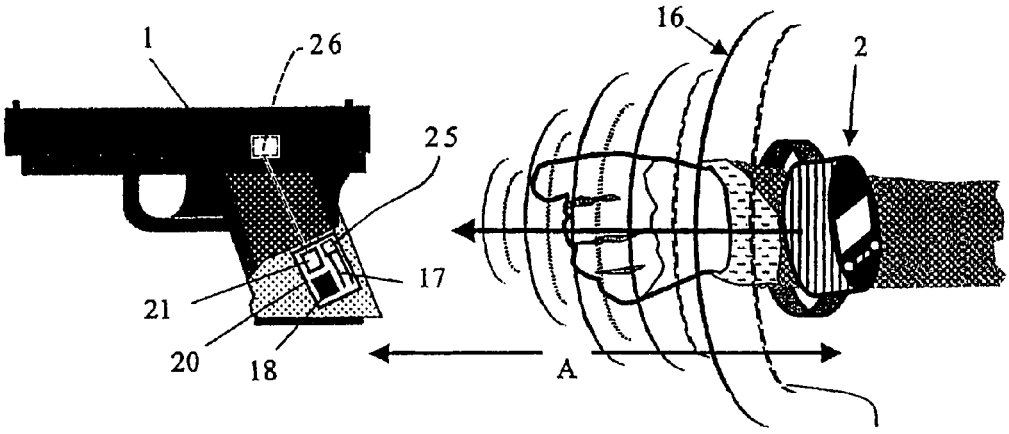
Fig. 1
Fig. 3
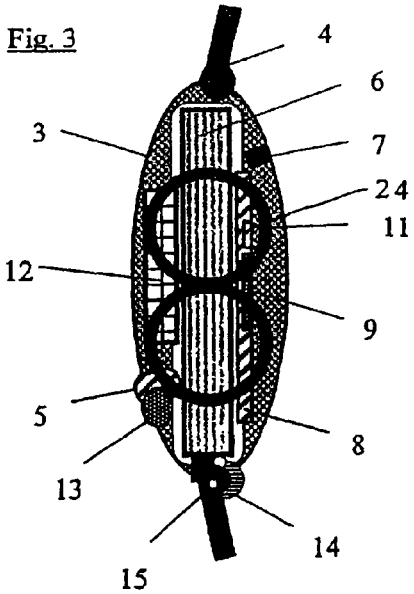
Fig. 2
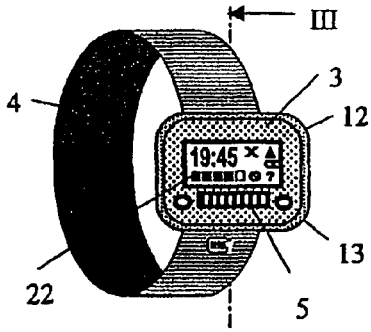

METHOD FOR ACTIVATING A WEAPON WITH AN IDENTIFICATION MECHANISM

This application is a divisional of U.S. patent application Ser. No. 10/263,373 filed Oct. 2, 2002, now abandoned.

FIELD OF THE INVENTION

The present invention relates to a system for activating a weapon to a state of readiness to fire.

BACKGROUND OF THE INVENTION

In order to prevent the use of a weapon by unauthorized persons, it is known to provide a sensor on the handle of the weapon to receive an identification code. One example of such a sensor is a fingerprint reader. Since input of the identification code takes a certain amount of time, such a weapon is not suited for use in a dangerous situation.

Alternative systems are known, wherein the user of the weapon carries an identification mechanism, such as a wristband, a wristwatch, a ring, gloves or the like, which is compatible with the sensor to read-in the identification code. The identification code can be, for example, a PIN code or a fingerprint pattern. The authorized user of the weapon, for example a policeman, inputs the identification code into the identification mechanism at a suitable time, such as the beginning of his shift. After a positive identification code comparison, the transmitter of the identification mechanism signals the receiver in the weapon, and the weapon is enabled to fire.

To maintain the readiness of the weapon to fire, the identification mechanism transmitter continuously communicates with the receiver via a coded signal, for example, a frequency-modulated signal. In such a situation, it is only possible to fire a shot while the signal is communicated. The communication medium can be radio, ultrasound or infrared (compare U.S. Pat. No. 5,062,232, U.S. Pat. No. 5,168,144, U.S. Pat. No. 5,461,812, WO98/04880, WO00/49360, WO00/55562, WO00/65291, WO01/18332, DE 43 03 333A1).

However, in these systems, communication between the transmitter and receiver can be paralyzed by a third party. For example, a criminal using a strong interfering transmitter can interfere with the signal, and thus disable the weapon from firing. Other problems occur also. For example, during an action by the police or other security forces, a policeman cannot use the weapon of a colleague, which could be necessary if the policeman runs out of ammunition or if the colleague is injured.

SUMMARY OF THE INVENTION

The purpose of the present invention is to prevent the use of a weapon by unauthorized persons, while reliably assuring that the weapon is ready to fire in a dangerous situation.

According to the present invention maintaining the readiness of a weapon to fire depends exclusively on the strength of a signal which is continuously received by a receiver in the weapon. This signal strength must be at least as great as the strength of the signals the receiver receives when the transmitter in the user's identification mechanism is at a specified maximum distance from the weapon. For example, where the weapon is a pistol and the identification mechanism is carried on a wristband, the maximum distance between the wrist on which the wristband is secured and the holster plus a certain safety zone might be two to three meters. Therefore, maintenance of the weapon in an activation or active state is completely independent of the frequency of the signals received by the receiver according to the present invention.

The communication between the identification mechanism transmitter and the receiver in the weapon can occur by radio, infrared or ultrasound signals according to the invention. Radio signals, in particular RF signals are, however, preferably used. Maintaining the readiness of the weapon to fire is therefore exclusively dependent or depends solely upon signals received by the receiver having a field strength which corresponds at least with the field strength of the signals the receiver receives when the transmitter is at a specified maximum distance from the receiver. Thus, the weapon is activated or maintained in the active state as long as signals are received with a field strength which is equal to or greater than the field strength of the signals the receiver receives from the transmitter at the specified maximum distance. The frequency of the signals received is therefore irrelevant. Therefore it is of no importance to the present system how the signals are frequency-modulated or if the signals are coded in another manner for the weapon to maintain the readiness to fire.

Since, according to the present invention, only the strength or the field strength of the received signals is important, the readiness of the weapon to fire cannot be disturbed by an interfering transmitter. The weapons of a policeman or, in the case of a task commando, the weapons of all of the task forces can therefore no longer be rendered functionless by a criminal with a strong interfering transmitter.

At the same time, it is possible during such action for a person with an identification mechanism which continuously sends appropriate signals to use the weapon of a colleague, if for example he has run out of ammunition or if the colleague is injured.

Of course it is possible for a criminal who has an interfering transmitter to tear the weapon away from the policeman or other authorized user, and to direct the weapon against him. However, a criminal will typically have a weapon in this case, or could obtain a weapon more readily than an interfering transmitter. Therefore, the potential for a criminal with an interfering transmitter, but without a weapon is an unrealistic possibility and this situation can be excluded from concern.

The identification mechanism carried by the weapon user can be integrated into a wristband, a wristwatch, a ring or a piece of clothing, such as gloves or the like, as indicated above. The identification code is preferably a biometric pattern, such as a fingerprint or the pattern of the user's hypodermic blood vessels, for instance those blood vessels on the wrist when used with a wristband. When a fingerprint is used as the identification code, a linear CCD (Charge Coupled Device) sensor is preferably used as the fingerprint reader. Such a sensor has fiber-glass optics, which permits only a vertical light incidence on the CCD sensor, with which the fingerprint pattern is scanned. Such a reader is preferable because it is rather insensitive to scratches.

The processor in the weapon is preferably a microchip, thus a microprocessor. The energy supply to the receiver, the microprocessor and any other necessary electronic/electric building components of the weapon can be provided by a battery or an accumulator. Thus the readiness of the weapon to fire can occur through an electromechanical unlocking carried out by an electromagnetic mechanism or through activation of the electronics during an electronic ignition. Either the battery or the accumulator can then also power these mechanisms.

To increase the life of the current supply, a wake-up circuit is preferably provided in the weapon. This circuit activates the microprocessor and the receiver when the receiver receives the activating signal from the transmitter. The circuit also deactivates the microprocessor and the receiver when the receiver is no longer receiving signals or receives only signals with a strength less than those received from a transmitter within the specified maximum distance from the receiver.

According to the present invention, both the identification mechanism and the weapon are inactive in the initial state, i.e. initial inactive state. The identification mechanism can include a switch which is initially turned on. The identification mechanism, for example the microprocessor of a fingerprint reader, is activated by this switch, which can be a Reed switch. When the identification mechanism is a wristband it is possible to close the switch when closing the wristband, thus activating the microprocessor.

In the above case, after closing the wristband at the start of a shift or prior to the use of the weapon, it is possible to input the identification mechanism or to read the fingerprint pattern without haste. After a positive comparison of the identification code by the microprocessor, here the fingerprints of the weapon user with fingerprints stored in a store in the identification mechanism, the identification mechanism is activated. In other words, an activation signal is sent to the receiver, which signal places the weapon into a state of readiness to fire, i.e. the aforementioned activation or active state. This activation signal can be a coded signal, such as a frequency-modulated RF signal or in other words, can be a coded activation signal.

When the receiver in the weapon and the transmitter in the identification mechanism are each configured to send and receive signals, the sending and receiving system in the weapon can transmit an answering signal to the sending and receiving system in the identification mechanism, thus inducing a transmission from the weapon regarding the state of the readiness to fire which is directed to the identification mechanism. The state of the readiness of the weapon to fire or whether the weapon must yet be activated can be indicated on an indicator of the identification mechanism. For example, a symbol or a particular background color of the indicator could indicate the state of readiness of the weapon. For instance, the indicator could display an indicator light when the weapon is in an inactive state and no such light when it is an active state. Moreover, the indicator can also indicate further functions, such as the charging state of the current supply in the weapon and/or the identification mechanism.

When the weapon is activated, and thus ready to fire, the identification mechanism transmitter continuously transmits a signal of a specified strength to the receiver in the weapon to maintain the activation of the weapon. This signal can be sent intermittently or continuously. Since only the strength of the signal, or in the case of an RF signal the field strength of this signal, is important in the present system, an uncoded signal can be used to maintain the activation of the weapon.

According to the present invention, the receiver in the weapon is configured to detect the strength, or in the case of a RF signal the field strength, of the signal. When the signal received by the receiver has a strength/field strength that is less than the strength/field strength programmed for the maximum specified distance from the identification mechanism, the weapon becomes inactive, or locked. This can occur when the user of the weapon places the weapon in a location and then moves away from that location or if the weapon is stolen from the user. When a wristband with a switch is used to carry the identification mechanism, the weapon will be deactivated when the wristband is opened, thus turning off the transmitter in the identification mechanism. This might occur at the end of a shift or after a task is completed and the wristband and weapon are put away.

The mechanism of the invention is designated in particular for locking hand firearms, such as pistols and guns.

BRIEF DESCRIPTION OF THE DRAWINGS

The mechanism of the invention will be discussed in greater detail exemplarily in connection with the enclosed drawings, in which:

FIG. 1 schematically illustrates an identification mechanism worn by the user of the weapon and a pistol with an exposed part;

FIG. 2 is a perspective view of an identification mechanism in the form of a wristwatch; and FIG. 3 is a cross-sectional view of the wristwatch of FIG. 2 along the section line III-III.

DETAILED DESCRIPTION

Referring to FIG. 1 the user carries a weapon 1, such as a pistol 1, and an identification mechanism 2. When the identification mechanism 2 is carried on a wristwatch as illustrated in FIGS. 2 and 3, the identification mechanism 2 is worn on the user's wrist. Such an identification mechanism 2 has a housing 3 and a wristband 4.

As illustrated in FIGS. 2 and 3, the identification mechanism 2 includes a sensor for detecting an identification code, namely a fingerprint reader 5, which is preferably a CCD sensor. The housing 3 also houses an accumulator 6, which is charged through a charging contact 7 or in another suitable manner, such as inductively. The fingerprint reader 5, an RF transmitter including the antenna 11, an LCD indicator 12 and the other electronic components of the identification mechanism 2 are controlled by a microprocessor 9 which is included on a printed circuit 8. A function key 13 is provided on the identification mechanism 2 and is configured to indicate the name or the picture of the authorized user of the weapon on the display 12.

A contact 14, such as a Reed contact, is provided on the housing 3. The contact 14 is closed when the wristband is fastened on the housing and closed. A magnet 15 is provided for this purpose in the catch on the wristband 4.

The microprocessor 9 has a store where the fingerprint pattern of the authorized person, or other identification code, is stored. The microprocessor 9 is configured as a comparator which compares the input fingerprint with the stored fingerprint. When the fingerprints match, the transmitter 24 sends an activating signal 16 to the weapon 1 (FIG. 1).

The weapon 1 includes a module 20, on which a receiver 25 which includes the receiving antenna 17, and a microprocessor 18 are included. The microprocessor 18 is configured to activate the weapon 1 upon receipt of an activation signal 16, thus placing the weapon 1 in a state of readiness to fire or in other words, in the active state which permits firing of the weapon. The weapon 1 is placed in this activated state by the unlocking of an electromechanical locking mechanism 26 or a similar safety mechanism.

Once the weapon 1 is activated by the signal 16, the distance A between the identification mechanism 2 and the weapon 1 is continuously monitored. This is so the weapon 1 is deactivated if the distance A exceeds the maximum preset distance from the identification mechanism 2 while the user carries the weapon 1, such as in a holster.

The transmitter 24 in the identification mechanism 2 continuously emits signals 19 toward the receiver 25 in the weapon 1 for the distance measuring function. When the field strength of the signals 19 received by the receiver 25 is less than the field strength of the signals 19 which the receiver 25 receives when the transmitter 24 of the identification mechanism 2 is at the specified maximum distance A from the receiver, the microprocessor 18 deactivates the weapon 1, thus placing the weapon in a state, i.e. the inactive state, in which it is prevented from firing.

A battery 21 supplies current in the weapon 1. A wake-up circuit is housed in the microprocessor 18, which turns on the microprocessor 18, the receiver and the other electronics in the weapon after receipt of an activation signal 16. The circuit is configured to turn off these components when continuous signals 19 are no longer received or when the signals 19 received from the receiver 24 have a field strength below the minimum field strength.

The indicator 12 indicates through the symbol x or through the illustrated light background if the weapon is locked. In one instance, the background of the indicator 12 could be dark if the weapon is live. The indicator 12 can include other symbols which represent a foreign interference frequency, a request to apply the finger or the like. In addition, the bar 22 indicates the charge state of the battery 21 or the accumulator 6.

To facilitate indication of the charge state of the battery 21, the transmitter 24 and the receiver 25 can each be configured as a sending and receiving system. This will allow the weapon 1 to transmit an answering signal to the sending and receiving system in the identification mechanism 2 once it is activated after receiving an activating signal 16. Thus a return signal will be transmitted by the weapon 1 to the identification mechanism 2 confirming the state of the readiness of the weapon to fire.

I claim:

1. A method of controlling the use of a weapon having a receiver and a processor secured thereto, the weapon being actuatable between an inactive state which prevents firing and an active state which permits firing, said method including the steps of:

providing a weapon having a receiver and a processor secured thereto, the weapon being actuatable between an inactive state which prevents firing and an active state which permits firing;

identifying an authorized user by an identification unit that is separate from the weapon;

transmitting from said identification unit a coded activation signal, which indicates identification of an authorized user for the weapon, to change said weapon from said inactive state to said active state and a continuous signal after the coded activation signal is transmitted in order to thereafter maintain said weapon in said active state;

receiving with the receiver the coded activation signal and then the continuous signal transmitted by the identification unit;

with the processor, placing the weapon in the active state from the inactive state when the receiver receives the coded activation signal;

after said step of placing the weapon in the active state, monitoring the signal strength of the continuous signal received by the receiver;

by said monitoring, maintaining the weapon in the active state exclusively dependent upon the monitored strength of the continuous signal being at or above a minimum signal strength, and regardless of a frequency of the continuous signal or either the presence or absence of the coded activation signal, so as to avoid a deactivation of the weapon solely by monitoring the strength of the continuous signal, and deactivating the weapon with the processor if the strength of the monitored continuous signal falls below the minimum strength.

2. The method of controlling the use of a weapon of claim 1, wherein:

prior to said steps of transmitting the coded activation signal and the continuous signal from the identification unit, entering into the identification unit an identification code;

with the identification unit, comparing the entered identification code to an identification code in the identification unit; and only if the entered identification code is the same as the identification code in the identification unit, performing said steps of transmitting the coded activation signal and the continuous signal from the identification unit.

3. The method of controlling the use of a weapon of claim 2, wherein, in said step of entering the identification code into the identification unit, the identification unit reads biometric data from an individual.

4. The method of controlling the use of a weapon of claim 2, wherein, said step of entering the identification code into the identification unit is performed by reading fingerprint data for an individual into the identification unit through a fingerprint reader attached to the identification unit.

5. The method of controlling the use of a weapon of claim 2, wherein, said step of entering the identification code into the identification unit is performed by reading fingerprint data for an individual into the identification unit through a CCD fingerprint reader attached to the identification unit.

6. The method of controlling the use of a weapon of claim 2, wherein:

a wristband is attached to the identification unit for holding the identification unit to an individual and the identification unit includes a switch for indicating if the wristband is closed; and the identification unit includes an identification unit processor for performing said step of comparing the entered identification code to the identification code in the identification unit and the switch is connected to the identification unit processor for actuating the identification unit processor only when the wristband is closed.

7. The method of controlling the use of a weapon of claim 2, wherein the continuous signal comprises a radio signal transmitted by the identification unit and received by the receiver; and said step of monitoring the strength of the continuous signal is performed by monitoring the strength of the radio signal.

8. The method of controlling the use of a weapon of claim 1, wherein the continuous signal comprises a radio signal transmitted by the identification unit and received by the receiver; and said step of monitoring the strength of the continuous signal is performed by monitoring the strength of the radio signal.

9. The method of controlling the use of a weapon of claim 1, wherein the coded activation signal and the continuous signal are selected from a group consisting of infrared signals and ultrasound signals.

10. The method of controlling the use of a weapon of claim 1, wherein the continuous signal comprises an uncoded signal.

11. The method of controlling the use of a weapon of claim 1, including, after the weapon is in the active state, transmitting a readiness signal from the weapon to the identification unit and displaying the state of readiness of the weapon on the identification unit.

12. A method for controlling the use of a weapon which is actuatable between an initial inactive state which prevents firing and an active state which permits firing, comprising the steps of:

providing a weapon which is actuatable between an initial inactive state which prevents firing and an active state which permits firing;

providing an identification mechanism that is separate from the weapon and carried by a user authorized to use said weapon, the identification mechanism including a transmitter having a transmitting antenna;

providing a module on the weapon comprising a receiver having a receiving antenna and a processor;

detecting an authorized user with the identification mechanism to authorize operation of the weapon;

transmitting from the identification mechanism using the transmitter and the transmitting antenna, upon detecting an authorized user, a coded activation signal followed by an uncoded signal wherein the coded activation signal signals the detection of an authorized user to effect a change in state of said weapon from said inactive state to said active state;

using the receiver having the receiving antenna to detect the coded activation signal and the uncoded signal;

placing the weapon in the active state by said processor upon receipt the coded activation signal to permit firing of the weapon;

monitoring a signal strength of the uncoded signal received by the receiver;

responsive to said monitoring, maintaining the weapon in the active state exclusively dependent upon the uncoded signal received by the receiver being at or above a minimum strength and regardless of a frequency of the uncoded signal and of whether an interference signal is received, wherein continued detection of the signal strength at or above said minimum strength exclusively maintains said weapon in said active state and prevents return of said weapon to said inactive state; and deactivating the weapon by the processor by returning the weapon to said inactive state to prevent firing of the weapon once the signal strength of the uncoded signal received by the receiver falls to a level less than the minimum strength during said monitoring.

13. The method of controlling the use of a weapon of claim 12, wherein the uncoded signal comprises an uncoded continuous RF signal and the activation signal comprises an RF signal.

14. The method of controlling the use of a weapon claim 12, the module including a wake-up circuit for the steps of:

activating the processor when the receiver receives the activation signal, and deactivating the processor when the received signal has a signal strength less than the minimum signal strength.

15. The method of controlling the use of a weapon of claim 12, wherein the identification unit is integrated into a wristband, and the identification unit includes a switch for indicating if the wristband is closed, the identification unit detecting an authorized user and transmitting the activation signal followed by the uncoded signal to place and maintain the weapon in the active state only when the wristband is closed.

16. The method of controlling the use of a weapon of claim 12, wherein both the activation signal and the uncoded signal consist of one of infrared energy and ultrasound energy.

17. The method of controlling the use of a weapon of claim 12, including the step of displaying the name or the picture of the authorized user on the identification mechanism.

18. A method of controlling the use of a weapon having a module with a receiver and a processor attached thereto, the method comprising:

providing a weapon having a module with a receiver and a processor attached thereto;

transmitting from an identification unit that is separate from the weapon and carried by a user authorized to use said weapon, a transmitted signal that comprises a coded activation signal and a continuous signal after the coded activation signal;

receiving at the receiver a received signal which comprises the transmitted signal from the identification unit;

monitoring the received signal received by the receiver in the module and, with the processor of the module, placing the weapon in an activated state to permit firing of the weapon if the received signal includes the coded activation signal;

after placing the weapon in the activated state, monitoring a signal strength of the received signal in the module;

by said monitoring, maintaining the weapon in the activated state exclusively dependent upon the signal strength of the received signal monitored in the module being at or above a minimum signal strength, and regardless of a frequency of the received signal or the presence or absence of the coded activation signal in the received signal;

wherein said maintaining step avoids a deactivation of the weapon from the activated state by a potential interfering signal from an interfering transmitter provided that the signal strength of the received signal is at or above the minimum signal strength during said maintaining step; and deactivating the weapon with the processor if the signal strength of the received signal falls below the minimum signal strength during said monitoring.

19. The method of controlling the use of a weapon of claim 18, wherein avoiding deactivation of the weapon from the activated state occurs when said signal strength is at or above the minimum signal strength such that the signal strength of the received signal may include a field strength of the potential interfering signal from the interfering transmitter without disturbing a readiness of the weapon to fire in the activated state.

20. The method of controlling the use of a weapon of claim 18, further comprising:

displaying at the identification unit the name or the picture of an authorized user of the weapon.

21. The method of controlling the use of a weapon of claim 18, wherein the continuous signal comprises an uncoded continuous RF signal and the coded activation signal comprises an RF signal.

22. The method of controlling the use of a weapon of claim 18, wherein both the coded activation signal and the continuous signal consist of one of infrared energy and ultrasound energy.

* * * * *